US005201883A

United States Patent [19]

Atoh et al.

[11] Patent Number: 5,201,883

[45] Date of Patent: Apr. 13, 1993

[54] METHOD OF MAKING IN-MOLDED PLUG CONNECTOR

[75] Inventors: Kiyoshi Atoh, Tokyo; Shinji Tanabe, Kawasaki, both of Japan

[73] Assignee: KEL Corporation, Tokyo, Japan

[21] Appl. No.: 800,829

[22] Filed: Nov. 27, 1991

[30] Foreign Application Priority Data

Aug. 30, 1991 [JP] Japan ..... 3-245089

[51] Int. Cl.[5] ..... H01R 43/16

[52] U.S. Cl. ..... 29/883; 29/884; 264/272.15

[58] Field of Search ..... 29/882, 883, 884, 874; 264/272.15

[56] References Cited

U.S. PATENT DOCUMENTS

| | | | |
|---|---|---|---|
| 3,618,207 | 11/1971 | Sand et al. | 29/884 X |
| 3,760,335 | 9/1973 | Roberts . | |
| 4,197,636 | 4/1980 | Osanai | 29/884 X |
| 4,337,574 | 7/1982 | Hughes et al. | 29/883 |
| 4,445,736 | 5/1984 | Hopkins | 29/883 X |
| 4,628,597 | 12/1986 | Meeham et al. | 29/884 X |
| 4,795,602 | 1/1989 | Pretchel et al. | 264/272.15 |

FOREIGN PATENT DOCUMENTS 55-3797 5/1975 Japan .

*Primary Examiner*—Carl J. Arbes

*Attorney, Agent, or Firm*—Robert W. J. Usher

[57] ABSTRACT

An electrical plug connector comprises an insulating plastic base and a first and second series of elongate metal contact security respective opposite major faces of the base by an in-molding step so that respective back surfaces of the contacts and parts of their side surfaces are embedded in the plastic material while connecting surfaces are exposed for engagement with a complementary connector. During the in-molding process a cavity is formed between the two series of contacts at a rear end of the base by a mold member supporting rear ends of the contacts of respective series in spaced apart, parallel relation while front ends of the contacts are supported by attachment to respective carrier strips. A plug is force fitted into the cavity subsequent to molding supporting the rear ends of the contacts. Leading, front ends of the contacts have laterally extending anchoring portions and tapering, inwardly extending tips completely covered by the plastic material to ensure double securement to the base.

7 Claims, 5 Drawing Sheets

METHOD OF MAKING IN-MOLDED PLUG CONNECTOR

FIELD OF THE INVENTION

The invention relates to an electrical connector, in particular to a plug connector and to a method for manufacturing the connector.

BACKGROUND OF THE INVENTION

A well known and widely used plug connector described in Japanese Patent Bulletin 55-3797 (U.S. Pat. No. 3,760,335), comprises a first and a second series of strip form contacts mounted to extend rearwardly, opposed in back-to-back relation along opposite faces of an insulating housing base from a leading edge thereof. The contacts are exposed above the base at front and rear ends which form connecting surfaces for contacts of a mating female connector and wire connecting portions for flat cable, respectively.

In view particularly of the inexorable trend to extreme miniaturization of electronic devices, it is of increasing importance that such plug connectors be of minimum size and weight.

However, conventionally, the contacts have been mounted on the base by forcible insertion therein e.g., stitching, into respective grooves or channels formed in the surface of the base. This requires the housing to be relatively robust and therefore relatively thick to withstand the insertion forces.

Furthermore, miniaturization requires that the contacts be located at very close pitch requiring still greater dimensional accuracy which is difficult to achieve by using the conventional contact insertion assembly step.

SUMMARY OF THE INVENTION

It is an object of the invention to provide an electrical plug connector which can be manufactured economically in very small sizes and with the requisite increased dimensional accuracy.

According to one aspect, the invention provides a method for manufacturing a plug connector comprising a first and a second series of elongate contacts having front connecting surfaces exposed on respective opposite faces of an insulating base, comprising the steps of:

providing first and second contact strips comprising a first and a second series of elongate contacts having connecting surfaces on one of their sides and attached at one of their ends to respective transversely extending carrier strips;

supporting respective contact strips in a mold with the contacts co-extending away from the carrier strips and the contacts of one strip located in opposed back-to-back relation with, and at a predetermined spacing apart from the contacts of the other strip;

forming a supporting base by injecting plastic material into the mold at locations between the two contact series covering the opposed back surfaces and at least part of the side surfaces of portions of the contacts adjacent the carriers, while maintaining the contacting surfaces exposed;

forming a connector base by removing the carriers from the series of supported contacts; and, locating a cover on the connector base so formed.

The elimination of the need both to form contact receiving grooves and to resist forces of a contact insertion step enables the plastic base part to be relatively thin enabling the connector to be both smaller and lighter while the contacts remain accurately located at a close pitch.

Preferably, rear end portions of each contact remote from the carrier strip are supported by placing a mold member therebetween during the molding of the base.

According to another aspect of the invention, a connector comprises an insulating plastic base having opposite side faces, a first and a second series of elongate contacts with connecting surfaces on one of their respective faces and in-molded in the base in opposed back-to-back relation at a predetermined spacing apart with the respective back surfaces and at least parts of the side surfaces of the contacts covered by the plastic base and their connecting surfaces exposed at respective faces; and a cover located in covering relation on the base.

Preferably, a cavity is formed at a rear of the base and between end portions of respective series of contacts and an insulating plug is force-fitted into the cavity thereby supporting the series of rear end portions in predetermined spaced apart relation.

A mold part defining the cavity provides support in the respective contact ends during the molding step ensuring accurate positioning thereof.

Suitably, respective contacts have leading ends side surfaces of which are formed with laterally extending anchoring portions covered by the plastic base.

The provision of the projections anchored in the base part anchors the front parts of the contacts in the base part obviating any tendency to separate from the face of the base part.

In a particular form the contacts of each series have rear end portions bent transversely to upstand away from the base faces and providing connecting surfaces, the contacts of one series being bent in an opposite direction from the contacts of the other series.

Preferably, portions of the contacts adjacent their rear ends are completely covered or embedded in the plastic base material which assists in preventing deformation of the bent parts.

The molding-in of the root portions of the bent parts strengthens the bent parts preventing deformation thereof.

BRIEF DESCRIPTION OF THE DRAWINGS

A specific embodiment of a plug connector according to the invention will now be described by way of example only and with reference to the accompanying drawings in which:

FIG. 9(*b*) is a side elevation of the contact strip shown in FIG. 9(*a*); and

FIG. 9(*c*) is a rear elevation of a portion of the contact strip as shown in FIG. 9(*a*);

Figure 1:
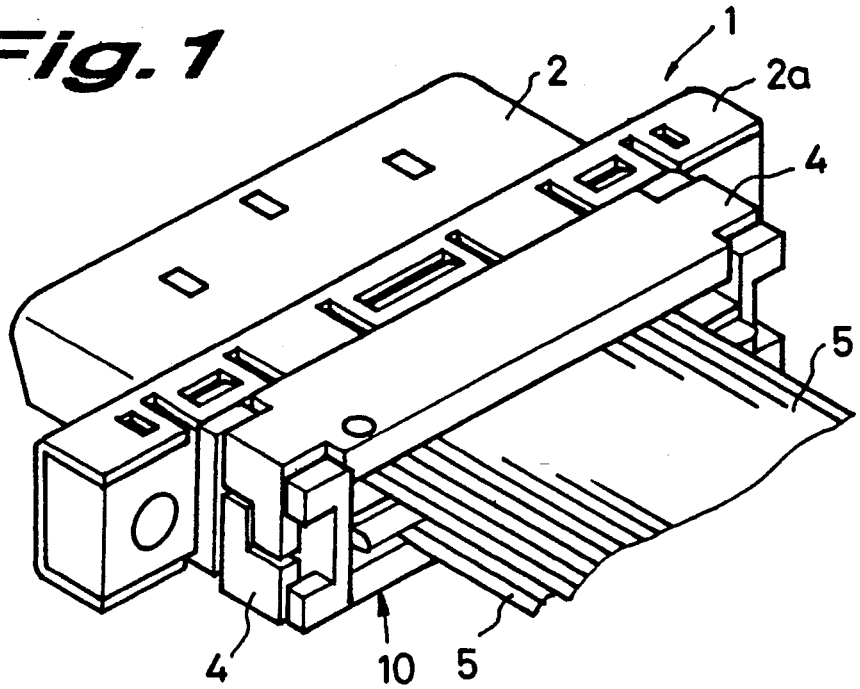
FIG. 1 is a rear perspective view of a plug connector according to the invention.
Figure 2:
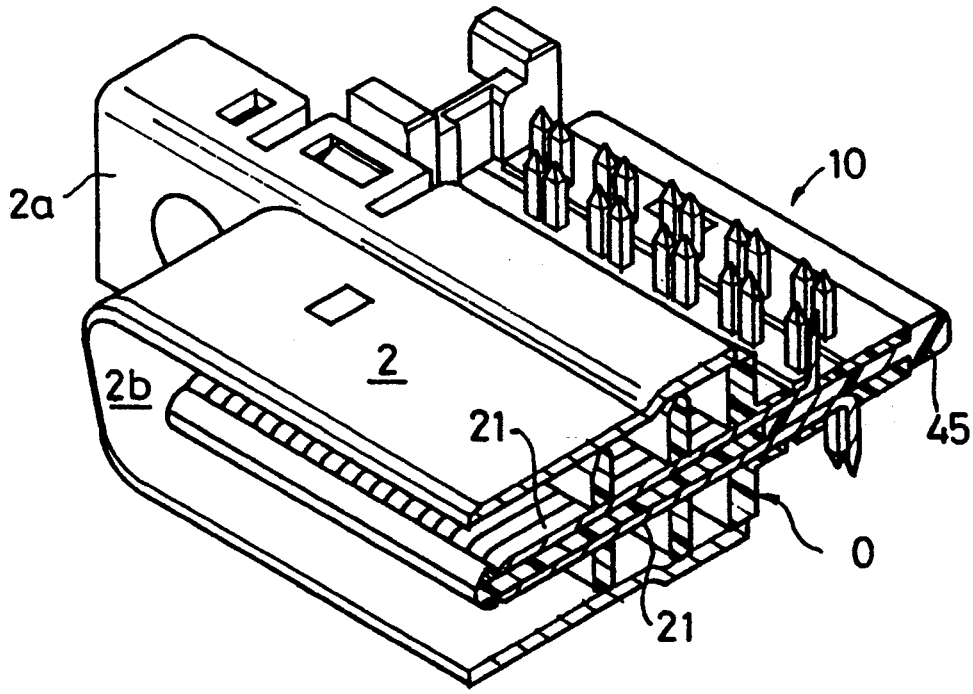
FIG. 2 is a perspective view, partly in cross-section of the plug connector with the cable retaining covers removed.
Figure 3:
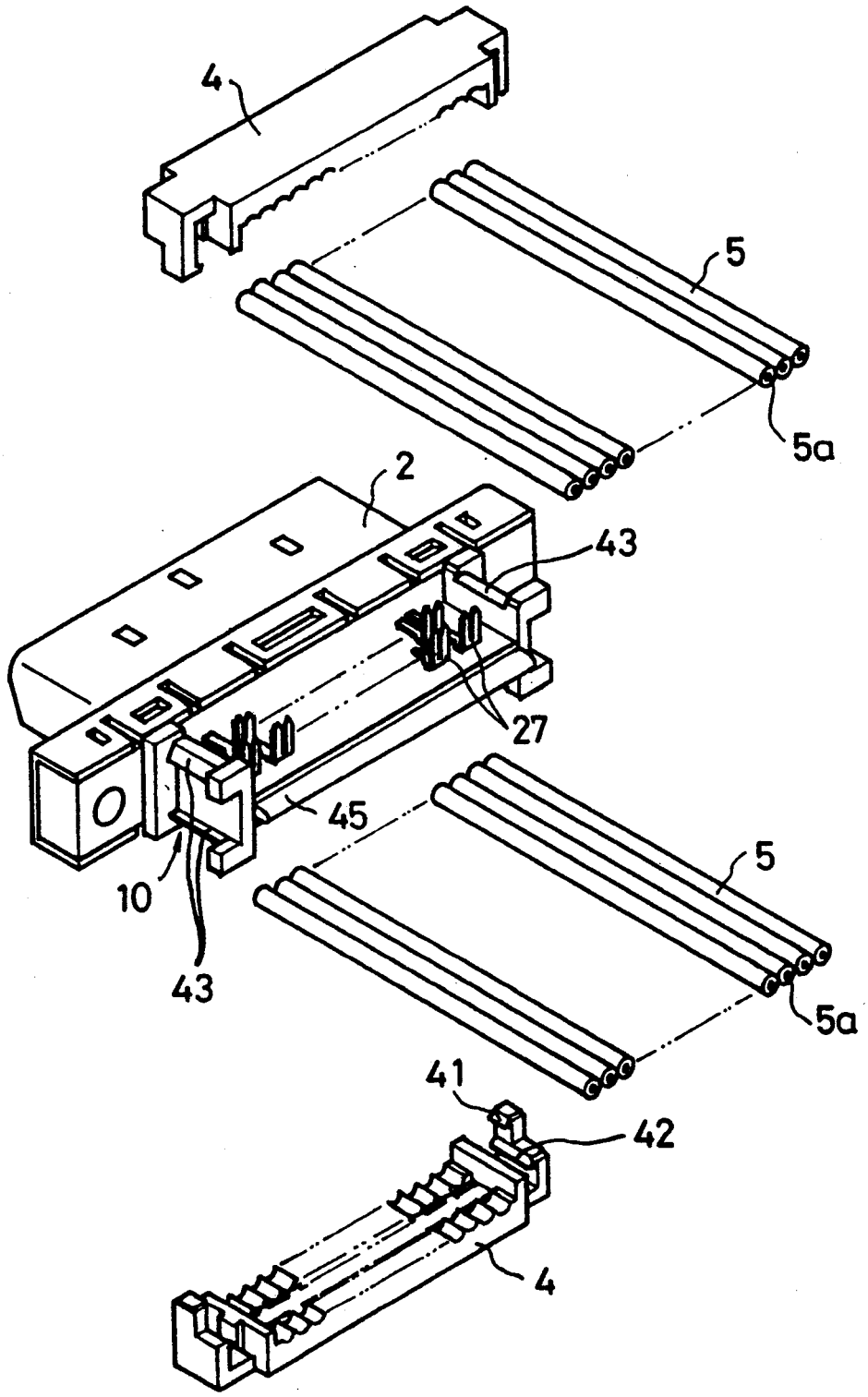
FIG. 3 is a perspective view of the rear of the plug connector with the cable retaining covers exploded apart.

As best seen in FIGS. 1-3, the plug connector consists of a connector base 10 comprising strip-form contacts 21 supported in upper and lower horizontal rows by a plastic (synthetic resin) connector base part 30, a metal hood-form shielding cover 2 mounted on the connector base 10 and an insulating, bipartite, pressure-contact cover for enclosing upper and lower rear parts for the connector base 10.

The cover 2 is formed in one piece with a flanged part 2*a* which extends rearwardly for mounting on a transverse rib portion formed centrally of the connector base, and defines a frontal opening 2*b*.

The connector base 10 projects at a front into the frontal opening 2*b* of the cover 2*a* forming a plug unit for connection with a complementary receptacle unit. A flat cable 5 is connected to a rear part of the connector base 10 and extends rearwardly therefrom. An insulating plug 45 is inserted in a cavity in the rear end of the connector base 10.

As shown in FIGS. 4-8, the upper and lower rows of contact parts 21 are arranged in opposed, back-two-back, parallel relation, on respective opposite faces of a supporting plastic base part 30.

Figure 9:
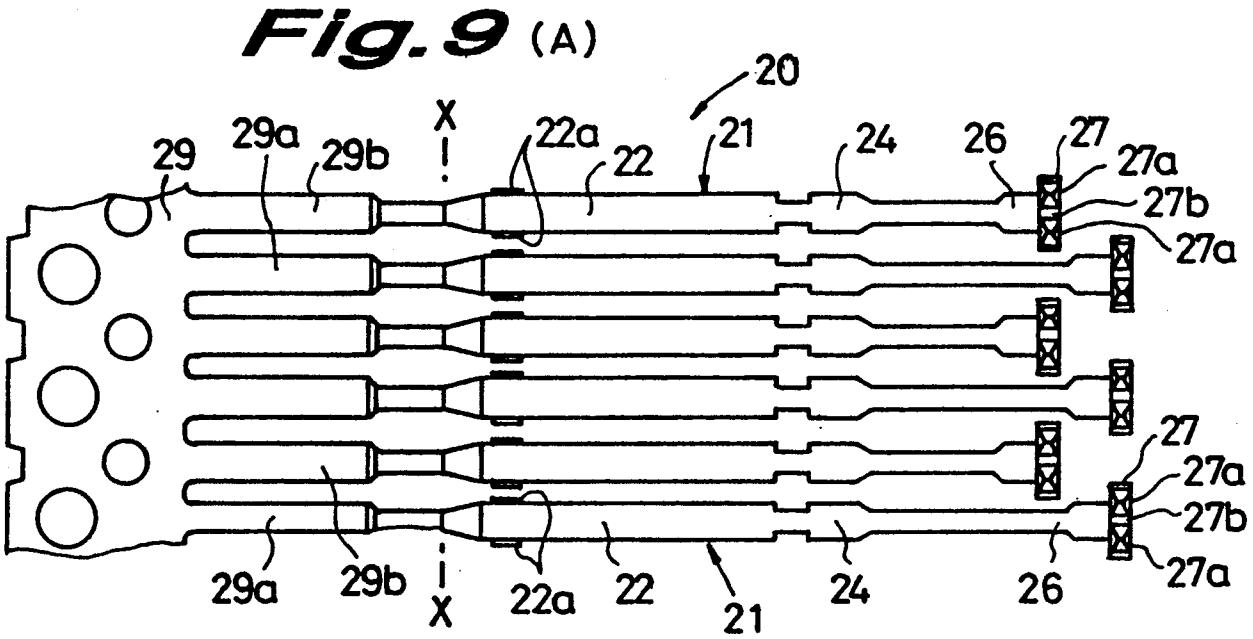
FIG. 9(*a*) is a plan view of the contact strip.
Figure 9:
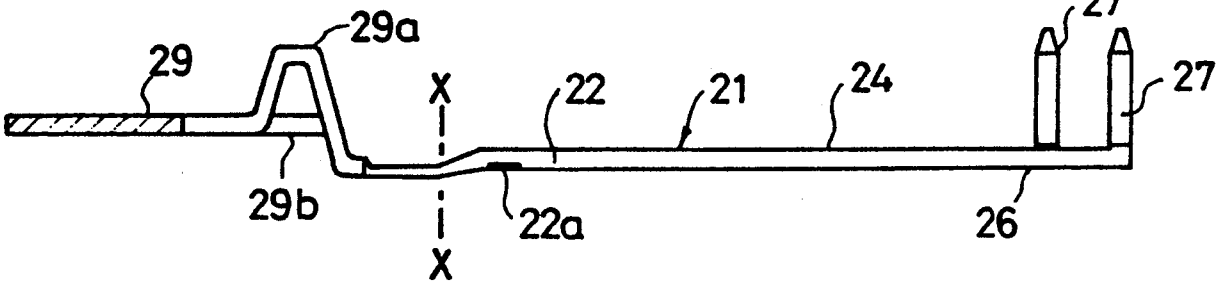
Figure 9:
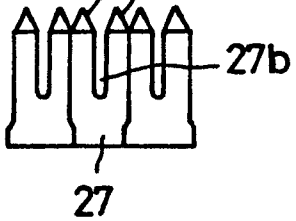

As shown in FIG. 9, the contact parts 21 are manufactured by stamping and forming from sheet metal and extend rearwardly in coextensive, parallel, relation from respective leads 29*a* and 29*b* of a transverse carrier 29 integrally joined to their front ends.

Each contact part 21 comprises a forward part 22, a central part 24, and a rear part 26.

The rear part 26 is bent to extend perpendicularly at a rear end forming an upstanding electrical connecting part 27 having a bifurcation providing two prongs 27*a* and 27*b* which define between them a wire receiving slot 27*b* into which the cable core wire 5*a* is pushed on penetration of the insulating sheath by the prongs.

The rear parts 26 of the contact parts 21 are alternately long and short so that, as shown in FIG. 9(A) the connecting parts 27 are staggered longitudinally. The contact parts 21 having longer rear parts 26 are bent or looped upwardly and fastened to the leads 29*a* while those of the short rear parts 26 are fastened to the substantially straight leads 29*b* supported by the carrier 29.

In addition, small lateral projections 22*a* are formed in both side surfaces of the forward parts 22 of the contact parts 21 and the tips are both reduced in thickness and deformed downwardly by striking to protrude below the level of the remainders of the contact parts to ensure that they are covered by a sufficient amount of plastic for reliable retention.

The contact strips 20 are supported by a mold member (not shown) in opposed, back-to-back, substantially parallel relation at a specific, constant spacing apart, one above the other. The resin or plastic material is injected into the mold and the base part 30 (FIG. 2), shown in FIGS. 4-7 and 9, formed by the insert molding step.

During the molding process, the intermediate support 31 is formed between the upper and lower contact parts 21 extending from their forward parts 22 to their middle parts 24 and pairs of transversely extending walls 32*a*, 32*b*, and 32*c*, are formed in spaced apart, parallel relation upstanding from the intermediate support and extending across the central parts 24 of the contact parts 21 and joined by rearwardly extending ribs 34 and 36, with walls 32*b* and 32*c* integrally joined at both opposite ends with flange forming portions 35 formed on respective opposite sides of the base part. A pair of transversely extending rear support parts 33 (33*a* and 33*b*) is also formed, such parts extending rearwardly from the upper surfaces of the rear parts 26 of the contact parts 21 and integrally joined to rearwardly extending flange portions 37 formed on respective opposite sides of the base part and which carry cover latching projections referred to below.

Thus, the intermediate molded parts 31, the central supporting walls 32 (32*a*, 32*b*, and 32*c*) the rear support 33, and the flange parts 35 are integrally formed as a one-piece body by the insert molding process.

Figure 4:
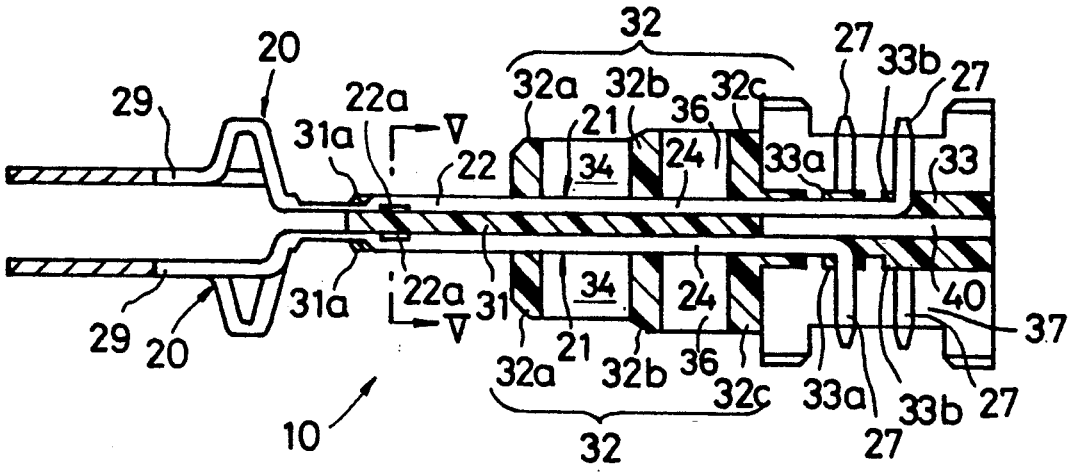
FIG. 4 is a cross-sectional view of the base of the plug connector taken along a longitudinal axis.
Figure 7:
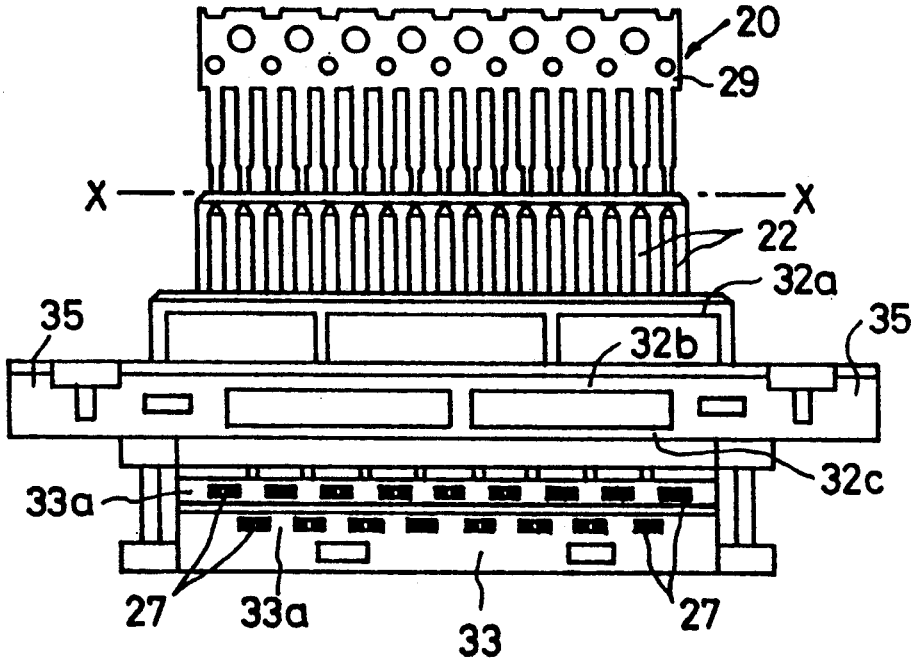
FIG. 7 is a plan view of the connector base of FIG. 6.
Figure 8:
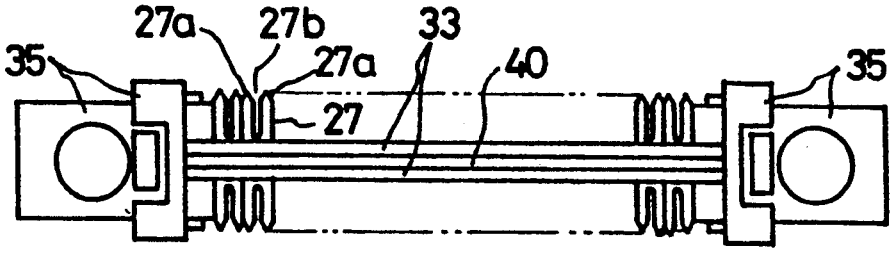
FIG. 8 is a rear elevation of the base of the plug connector.

The central parts 24 of the contacts extending between respective walls 32*a*, 32*b*, 32*c* and rear support parts 33*a* and 33*b* are covered by a very thin film of plastic formed by the molding process, as shown in FIG. 7 (but not shown in FIG. 4).

It will be apparent to the skilled technician that the mold used for the formation of the above-described body structure has cavity defining parts which correspond to the aforementioned intermediate molded parts 31, walls 32, rear support parts 33 and the rear flange parts 35.

As shown in FIG. 4, a rearwardly opening cavity is formed by a mold part between the rear parts 26 of the upper and lower contact parts 21, i.e., between the rear support parts 33 of the two series of contacts. The mold part supports the rear contact parts 26 during the molding step.

The front parts 22 of the contact parts 21 are also reliably supported by the carrier 29 to which they are integrally attached. The reliable support of the front parts 22 and the rear parts 26 during the insert molding enables the positional accuracy of the contact parts to be obtained with a high degree of precision.

As the cavity or space 40 remains after molding, to obviate the possibility of inward deformation of the rear parts 26 under the insertion force of a flat cable and to assure insulation between the contact parts 26, a plug part 45 made from insulating material is forcibly inserted in the cavity 40.

The rear supporting parts 33 of the base part 30 surround and cover root ends (i.e., bent part) of the electrically connecting parts 27 thereby supporting and strengthening the root parts obviating risk of deformation or damage during pressure connection to a flat cable. In addition, the rear supporting parts 33 extend completely over the rear, horizontal extending parts 26 and extend between side surfaces of the contact parts 21 securing such parts.

Figure 5:
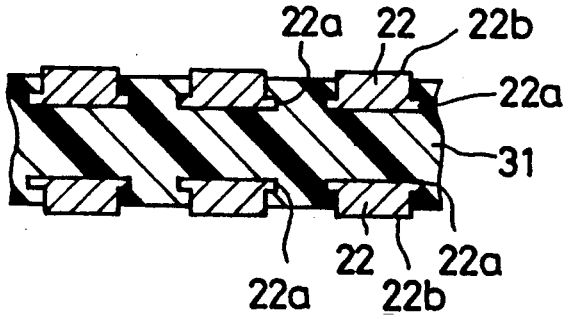
FIG. 5 is a cross-sectional view taken along line 5—5 of FIG. 4.

In addition, the end 31*a* of the intermediate molded part 31, as shown in FIG. 4, protrudes outwardly and upwardly beyond the ends of the contact parts 21 thereby supporting such parts. As shown in FIG. 5, upper edge portions of the side surfaces of the front parts 22 of the contacts are exposed and the connecting outer surfaces 22*b* are completely exposed for connecting purposes.

The anchoring projections 22*a* formed in both sides of the contact parts 21 are completely covered by the intermediate molded parts 31 so that the leading ends of the contacts are supported by and prevented from being lifted away from the molded part 31.

Figure 6:
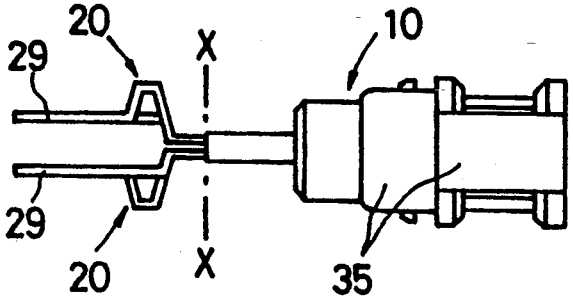
FIG. 6 is a side elevation of the connector base shown in FIG. 4.

After the base part 30 is formed by the insert molding step described above, the carrier 29 is cut away along the line X—X in FIGS. 6 and 7 completing the contact base 10.

Subsequently, the shielding cover 2 is installed on the contact base 10 and, as shown in FIG. 3, ends of flat cables 5 are aligned with respective pressure-contact covers 4.

The covers 4 are hermaphroditic and mountable on the housing in preliminary and final positions. Each cover is provided with a first latch 41 engaging with a projection 43 formed on the housing body, primarily for retaining the cover on the housing body, and a second latch 42 engaging with the projection 43, for securing the cover to the housing body after the cable is press-terminated in the contacts by pressing down the cable cover. The first latch 41 has a width half that of the second latch 42.

In the preliminary position, a large force is not applied to the cable cover and thus the first latch has a smaller width, but the second latch has a larger width, because it is subject to a large force.

Since the pair of first latches have a width equivalent to or smaller than that of the second latch, the first latches do not abut or engage each other, and thus the connector body can have a low profile.

The elimination of a post-molding contact insertion step enables the connection to be economically manufactured from less plastic material while the in-molding method of the invention enables increased accuracy of contact location at closer pitch.

We claim:

1. A method for manufacturing a plug connector of the type comprising a first and a second series of elongate, strip-form contacts having elongate connecting portions adjacent leading ends with front connecting surfaces exposed on respective opposite faces of a supporting insulating base for engagement with complementary surfaces of a female connector to establish electrical connection therewith, comprising the steps of:

providing first and second contact strips comprising a first and a second series of elongate, strip-form contacts, respectively each contact having a connecting portion adjacent a leading end with an elongate, front connecting surface and an underlying back surface joined thereto by side surfaces the contacts of respective series being, attached at respective leading ends to respective, transversely extending carrier strips;

supporting respective contact strips in a mold with the contacts extending in the same direction away from the respective carrier strips and the contacts of one strip located with respective back surfaces in opposed, back-to-back, coplanar relation with, and at a predetermined spacing apart from the respective back surfaces of the contacts of the other strip;

forming a supporting base by injecting plastic material into the mold at locations between the two contact series covering the opposed back surfaces of the connecting portions and at least part of the side surfaces of portions of the contacts adjacent the carrier strips, while maintaining the front, connecting surfaces exposed so as to extend in parallel relation rearwardly across opposite faces of the base from a leading end thereof;

forming a connector base by removing the carrier strips from the series of supported contacts; and, locating a cover on the connector base so formed.

2. A method according to claim 1 including the step of supporting rear end portions of each contact remote from the carrier strip by placing a mold member therebetween during the molding of the base.

3. A method according to claim 1 in which the contact strips are supported with front connecting surface of each contact extending proud of the base material.

4. A method according to claim 1 including the step of providing, prior to the supporting step, anchoring portions protruding laterally from respective opposite side surfaces of the connecting portions and covering said anchoring portions by the plastic material by the injection thereof.

5. A method according to claim 1 including the step of forming, prior to the supporting step, arm pairs on trailing ends of respective contacts to extend perpendicularly thereto, respective arms of each pair defining between them wire receiving slots and the slots of contacts of each series opening away from each other, in opposite directions; forming a cavity underlying respective arm pairs by the injection step and force-fitting an insulating plug into the cavity thereby supporting the trailing ends of respective series of contacts in predetermined spaced apart relation.

6. A method for manufacturing a plug connector of the type comprising a first and a second series of elongate, strip-form contacts having elongate connecting portions adjacent leading ends with front connecting surfaces exposed on respective opposite faces of a supporting insulating base for engagement with complementary surfaces of a female connector to establish electrical connection therewith, comprising the steps of:

providing first and second contact strips comprising a first and a second series of elongate, strip-form contacts, respectively each contact having a connecting portion adjacent a leading end with an elongate, front connecting surface and an underlying back surface joined thereto by side surfaces, and anchoring portions protruding laterally from respective opposite side surfaces of the connecting portions, the contacts of respective series being, attached at respective leading ends to respective, transversely extending carrier strips; arm pairs on trailing ends of respective contacts extending perpendicularly thereto, respective arms of each pair defining between them wire receiving slots and the slots of contacts of each series opening away from each other, in opposite directions;

supporting respective contact strips in a mold with the contacts extending in the same direction away from the respective carrier strips and the contacts of one strip located with respective back surfaces in opposed, back-to-back, coplanar relation with, and at a predetermined spacing apart from the respective back surfaces of the contacts of the other strip and supporting rear end portions of each contact remote from the carrier strip by placing a mold member therebetween;

forming a supporting base by injecting plastic material into the mold at locations between the two contact series covering the opposed back surfaces of the connecting portions and at least part of the side surfaces of portions of the contacts adjacent the carrier strips including the anchoring portions, while maintaining the front, connecting surfaces exposed so as to extend in parallel relation rearwardly across opposite faces of the base from a leading end thereof, the mold member forming a cavity underlying respective arm pairs;

forming a connector base by removing the carrier strips from the series of supported contacts;

force-fitting an insulating plug into the cavity thereby supporting the trailing ends of respective series of contacts in predetermined spaced apart relation; and, locating a cover on the connector base so formed.

7. A method according to claim 6 in which the contact strips are supported with the front connecting surface of each contact extending proud of the base material.

* * * * *